US008984833B2

(12) United States Patent
Manser et al.

(10) Patent No.: US 8,984,833 B2
(45) **Date of Patent: *Mar. 24, 2015**

(54) BUILDING WALL SYSTEM

(71) Applicant: Kingspan Insulated Panels, Inc. (USA), Deland, FL (US)

(72) Inventors: Ian J. Manser, Orlando, FL (US); Brian Glancy, Toronto (CA)

(73) Assignee: Kingspan Insulated Panels, Inc., Deland, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/134,104

(22) Filed: Dec. 19, 2013

(65) Prior Publication Data

US 2014/0102029 A1 Apr. 17, 2014

Related U.S. Application Data

(63) Continuation of application No. 13/291,622, filed on Nov. 8, 2011, now Pat. No. 8,621,810.

(60) Provisional application No. 61/447,278, filed on Feb. 28, 2011.

(51) Int. Cl.

| | |
|---|---|
| ***E04B 2/88*** | (2006.01) |
| ***E04B 1/41*** | (2006.01) |
| ***E04F 13/08*** | (2006.01) |
| ***E04F 13/12*** | (2006.01) |

(52) U.S. Cl.

CPC ..... *E04B 2/88* (2013.01); *E04B 1/4178* (2013.01); *E04F 13/0871* (2013.01); *E04F 13/12* (2013.01)

USPC ..... 52/506.05; 52/235; 52/506.03; 52/506.1

(58) Field of Classification Search

CPC ..... E04F 13/0894; E04F 13/0803; E04B 1/4178; E04C 2/292

USPC ..... 52/235, 302.1, 309.9, 506.03, 506.05, 52/506.08, 506.1, 510, 513

See application file for complete search history.

(56) References Cited

U.S. PATENT DOCUMENTS

| | | | |
|---|---|---|---|
| 3,300,934 | A | 1/1967 | Waizenhofer |
| 3,324,617 | A | 6/1967 | Knight et al. |
| 3,438,168 | A | 4/1969 | Tischuk |
| 3,474,583 | A | 10/1969 | Manias |
| 3,522,683 | A | 8/1970 | Wise |

(Continued)

FOREIGN PATENT DOCUMENTS

| | | |
|---|---|---|
| EP | 1 179 645 | 10/2005 |
| GB | 2 313 389 | 11/1997 |

(Continued)

*Primary Examiner* — Jeanette E Chapman
*Assistant Examiner* — James Buckle, Jr.
(74) *Attorney, Agent, or Firm* — Harness, Dickey & Pierce, P.L.C.

(57) ABSTRACT

A building wall system has a plurality of panels positioned adjacent one another for securement to a frame structure of a building via a plurality of fasteners. A plurality of rails secures a façade to the panels. Each rail has a first, second and third portion. The first portion receives the fasteners to secure the bracket to the frame structure. The second portion provides a surface for securement with the façade. The second portion is spaced from the panel so that fasteners do not enter the panel. The third portion rests against the panel to provide rigidity for the rail.

23 Claims, 9 Drawing Sheets

(56) References Cited

U.S. PATENT DOCUMENTS

| | | | | |
|---|---|---|---|---|
| 3,667,180 | A | 6/1972 | Tischuk | |
| 3,678,642 | A | 7/1972 | Scott | |
| 3,998,016 | A | 12/1976 | Ting | |
| 4,133,158 | A | 1/1979 | Ting | |
| 4,250,678 | A | 2/1981 | Skuran | |
| 4,262,464 | A * | 4/1981 | Ludowici | 52/510 |
| 4,286,420 | A | 9/1981 | Pharmakidis | |
| 4,602,468 | A | 7/1986 | Simpson | |
| 4,700,520 | A | 10/1987 | Ting | |
| 4,866,896 | A | 9/1989 | Shreiner et al. | |
| 4,936,078 | A | 6/1990 | Porter | |
| 5,220,759 | A | 6/1993 | Hossli | |
| 5,373,678 | A | 12/1994 | Hesser | |
| 5,425,210 | A | 6/1995 | Zafir | |
| 5,544,461 | A | 8/1996 | Sommerstein | |
| 5,678,369 | A | 10/1997 | Ishikawa et al. | |
| 5,749,282 | A | 5/1998 | Brow et al. | |
| 5,956,910 | A | 9/1999 | Sommerstein et al. | |
| 6,070,382 | A | 6/2000 | Ettema | |
| 6,170,214 | B1 * | 1/2001 | Treister et al. | 52/511 |
| 6,202,377 | B1 | 3/2001 | Krieger | |
| 6,226,947 | B1 | 5/2001 | Bado et al. | |
| 6,253,511 | B1 | 7/2001 | Boyer | |
| 6,279,287 | B1 | 8/2001 | Meadows | |
| 6,315,489 | B1 * | 11/2001 | Watanabe | 403/381 |
| 6,349,507 | B1 * | 2/2002 | Muellerleile | 52/36.5 |
| 6,470,647 | B2 | 10/2002 | Hsueh | |
| 6,615,560 | B2 * | 9/2003 | Ito | 52/506.06 |
| 6,637,170 | B2 * | 10/2003 | Ito | 52/506.06 |
| 6,830,405 | B2 * | 12/2004 | Watanabe | 403/14 |
| 6,895,721 | B2 | 5/2005 | Watanabe et al. | |
| 7,665,260 | B2 * | 2/2010 | Hikai | 52/506.05 |
| 7,748,181 | B1 | 7/2010 | Guinn | |
| 8,621,810 | B2 | 1/2014 | Manser et al. | |
| 2002/0023398 | A1 * | 2/2002 | Ito | 52/220.1 |
| 2004/0216416 | A1 | 11/2004 | Hohmann et al. | |
| 2005/0210800 | A1 | 9/2005 | Wobber | |
| 2006/0037282 | A1 | 2/2006 | Layfield | |
| 2006/0265988 | A1 * | 11/2006 | Fujito et al. | 52/511 |
| 2007/0022682 | A1 | 2/2007 | Morgenegg et al. | |
| 2008/0127586 | A1 | 6/2008 | Carolan | |
| 2010/0170173 | A1 | 7/2010 | Boyer et al. | |
| 2010/0205883 | A1 | 8/2010 | Carson | |
| 2010/0229484 | A1 | 9/2010 | Carolan et al. | |
| 2010/0263314 | A1 | 10/2010 | MacDonald et al. | |

FOREIGN PATENT DOCUMENTS

| | | |
|---|---|---|
| JP | 2005-90137 | 4/2005 |
| WO | WO96/24734 | 8/1996 |
| WO | WO2004/101907 | 11/2004 |

* cited by examiner

BUILDING WALL SYSTEM

CROSS-REFERENCE TO RELATED APPLICATIONS

This application is a continuation of U.S. patent application Ser. No. 13/291,622, filed on Nov. 8, 2011, which claims the benefit of U.S. Provisional Application No. 61/447,278, filed on Feb. 28, 2011. The entire disclosures of the above applications are incorporated herein by reference.

FIELD

The present disclosure relates to building materials and, more particularly, to a building wall system.

BACKGROUND

Various types of building wall systems exist in the art. Ordinarily, a building wall includes a framing structure, insulated portion and a façade portion. A mechanism secures the façade portion to the insulated portion. In commercial structures, the insulation portion is generally formed by a plurality of architectural panels that are secured to one another. Various types of mechanism secure the façade to the architectural panels. Ordinarily, the panels include a front and rear metallic skin that sandwich an interior foam insulating material. The insulating foam material is adhesively bonded or the like with the metallic skins to form the panels. The panels range in thickness from 1 inch to 6 inches or more and have a length anywhere from 6 feet to 60 feet long. Additionally, the width of the panels varies from 1 foot to about 5 feet. Thus, a wall or roof can be positioned onto the framing structure to rapidly enclose the building.

It is desirable to attach or hang the façade onto the panels. When hanging the façade, it is desirable to provide a moisture, air and thermal barrier between the façade and the panel and frame structure. Also, it is desirable to provide a rigid surface for the attachment of the façade.

The present disclosure provides the art with a building wall system that overcomes the disadvantages of the prior systems. The present building wall system provides a rigid surface to secure the façade. The present disclosure provides a moisture, air and thermal barrier between the facade, panels and frame. The present disclosure utilizes necessary securement fasteners required to hang the panels.

SUMMARY

According to one aspect of the disclosure, a building wall system comprises a plurality of insulated panels. The plurality of insulated panels is positioned adjacent to one another in a vertical or horizontal arrangement. The panels are secured to a frame structure of a building via fasteners. A plurality of rails is secured to the frame structure. Each rail includes a first, second, and third portion. The first portion includes a mechanism to receive the fasteners to secure the rail to the frame structure. The second portion receives fasteners to secure a façade. The second portion is spaced from the insulated panel such that the façade securing fasteners do not enter into the panels. A third portion supports the second portion. The third portion rests against the panel and provides rigidity for the second portion. The third portion may have a free end and may also be secured. A mechanism is coupled with the rail to enhance securement of the façade. The first, second and third portions are continuous with one another and form a one piece rail. The second and third portions have a top hat cross section. Additionally, the second and third portions may have a labyrinth or rectangular helix cross section. The rail includes a plurality of apertures to receive the mechanisms to enhance securement of the façade. A gap is provided between the façade and the panels to provide a moisture, air and thermal barrier.

According to a second aspect of the disclosure, a building comprises a frame structure, a wall system and a façade. The wall system includes a plurality of insulated panels that is positioned adjacent to one another in a vertical or horizontal arrangement. The insulated panels are secured to the frame structure via fasteners. A plurality of rail is secured with the frame structure. Each rail includes a first, second and third portion. The first portion includes a mechanism to receive the fasteners to secure the rail to the frame structure. The second portion receives the fasteners to secure the façade. The second portion is spaced from the insulated panels such that the façade securing fasteners do not enter into the panels. The third portion supports the second portion. The third portion rests against the insulated panels and provides rigidity to the second portion. The third portion may have a free end. Alternatively, the third portion may be secured to the panel. A mechanism is coupled with the rail to enhance securement of the façade. The first, second and third portions are continuous with one another and form a one piece rail. The second and third portions have a top hat cross section. Additionally, the second and third portions may have a labyrinth or rectangular helix cross section. The rail includes a plurality of apertures to receive the mechanisms to enhance securement of the façade. A gap is provided between the façade and the panels to provide a moisture, air and thermal barrier.

According to a third aspect of the disclosure, a method of building a building wall system comprises positioning a first panel adjacent a framing structure. A rail is aligned with the first panel. A securement mechanism secures the rail and the first panel to the framing structure, via fasteners. The panel securement and alignment continues until a building wall system is formed. A façade is attached to the rails. Additionally, a securing mechanism may be coupled with the rails to enhance attaching of the façade. The rails are only secured to the framing structure utilizing the fasteners that also secure the panels to the framing structure. A moisture air and thermal barrier is provided between a façade and the wall panels.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

Figure 3:
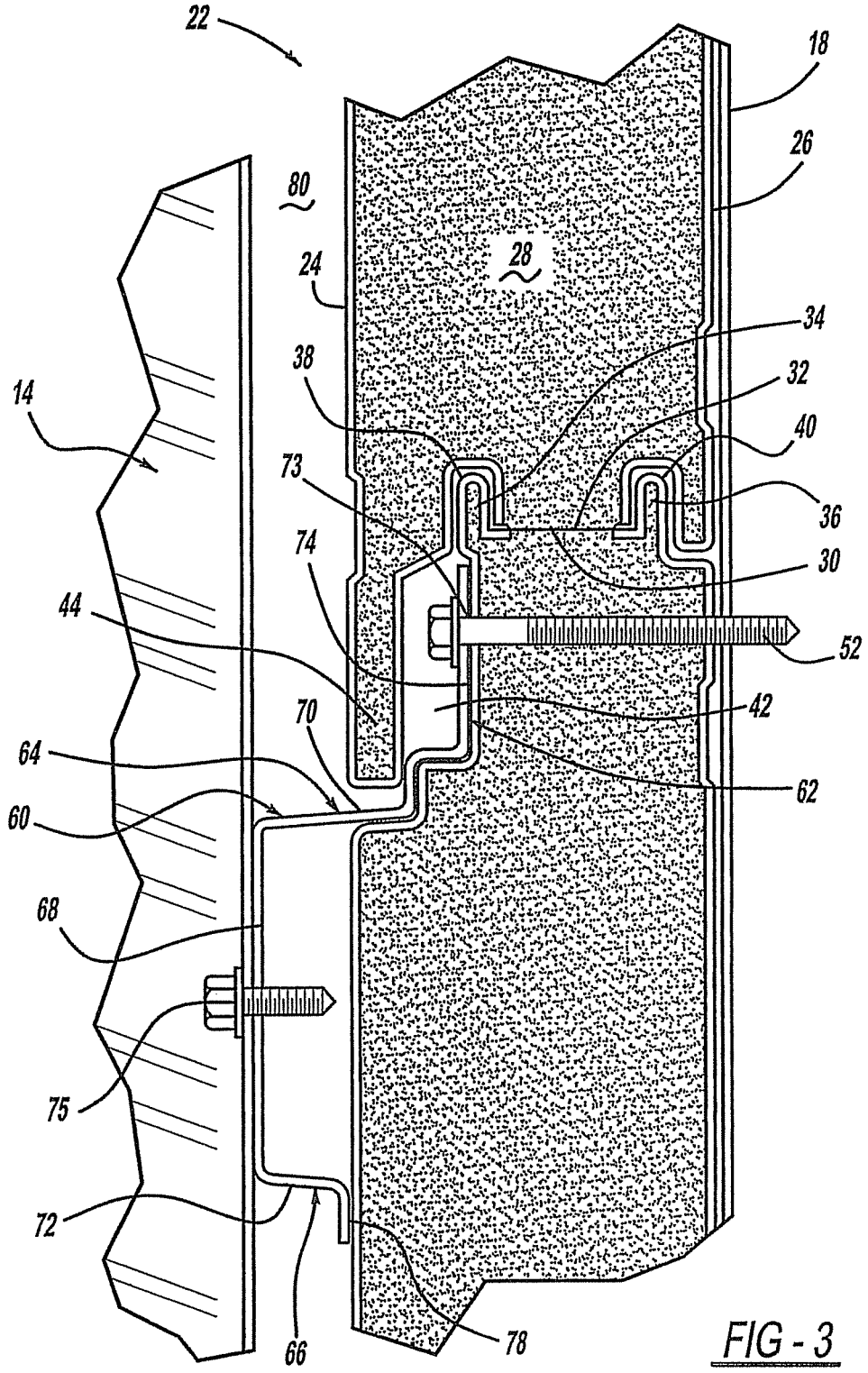
FIG. 3 is a cross-section view of FIG. 2.
Figure 3A:
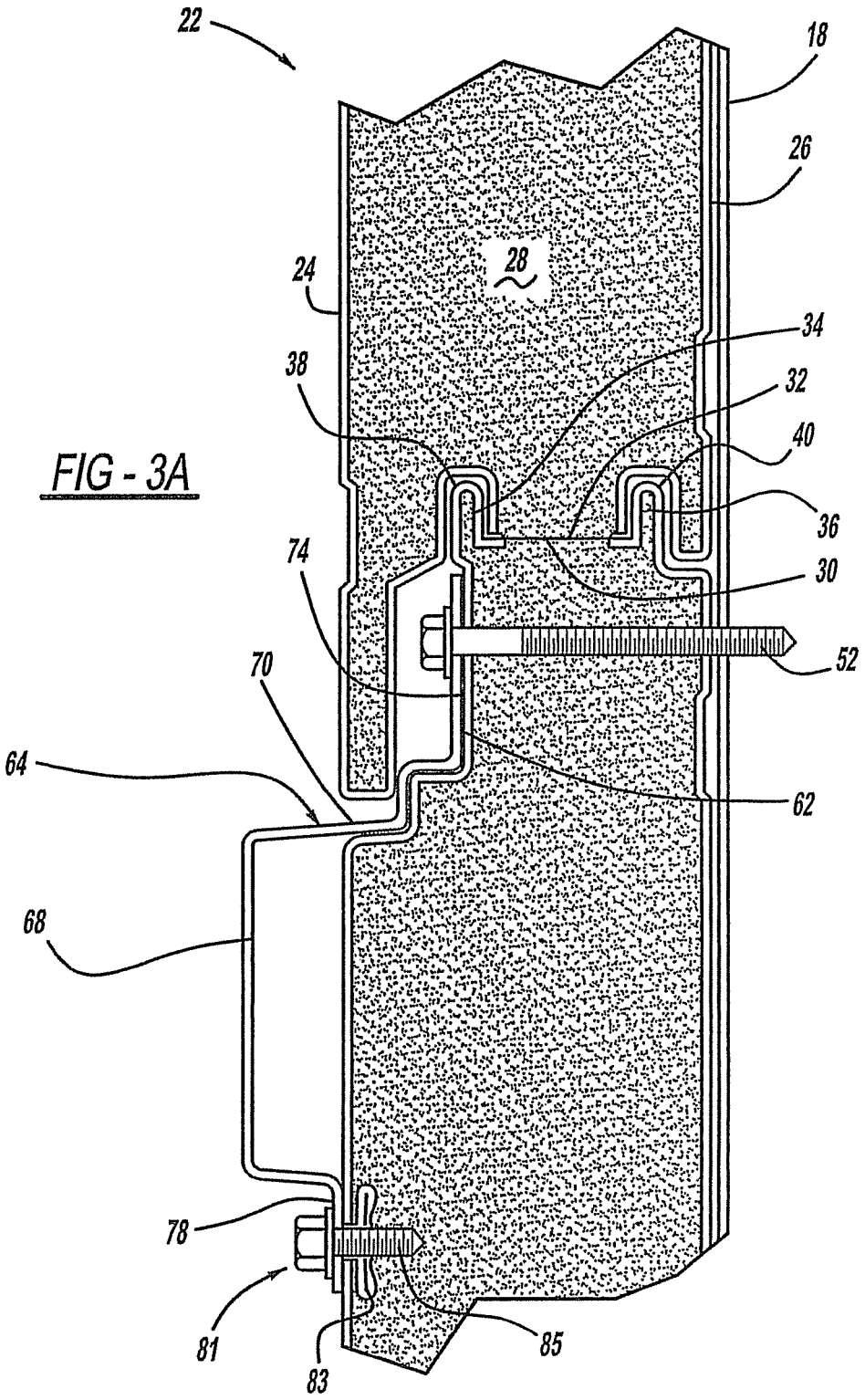

FIG. 3*a* is a view like FIG. 3 with a fastening mechanism.

Figure 2:
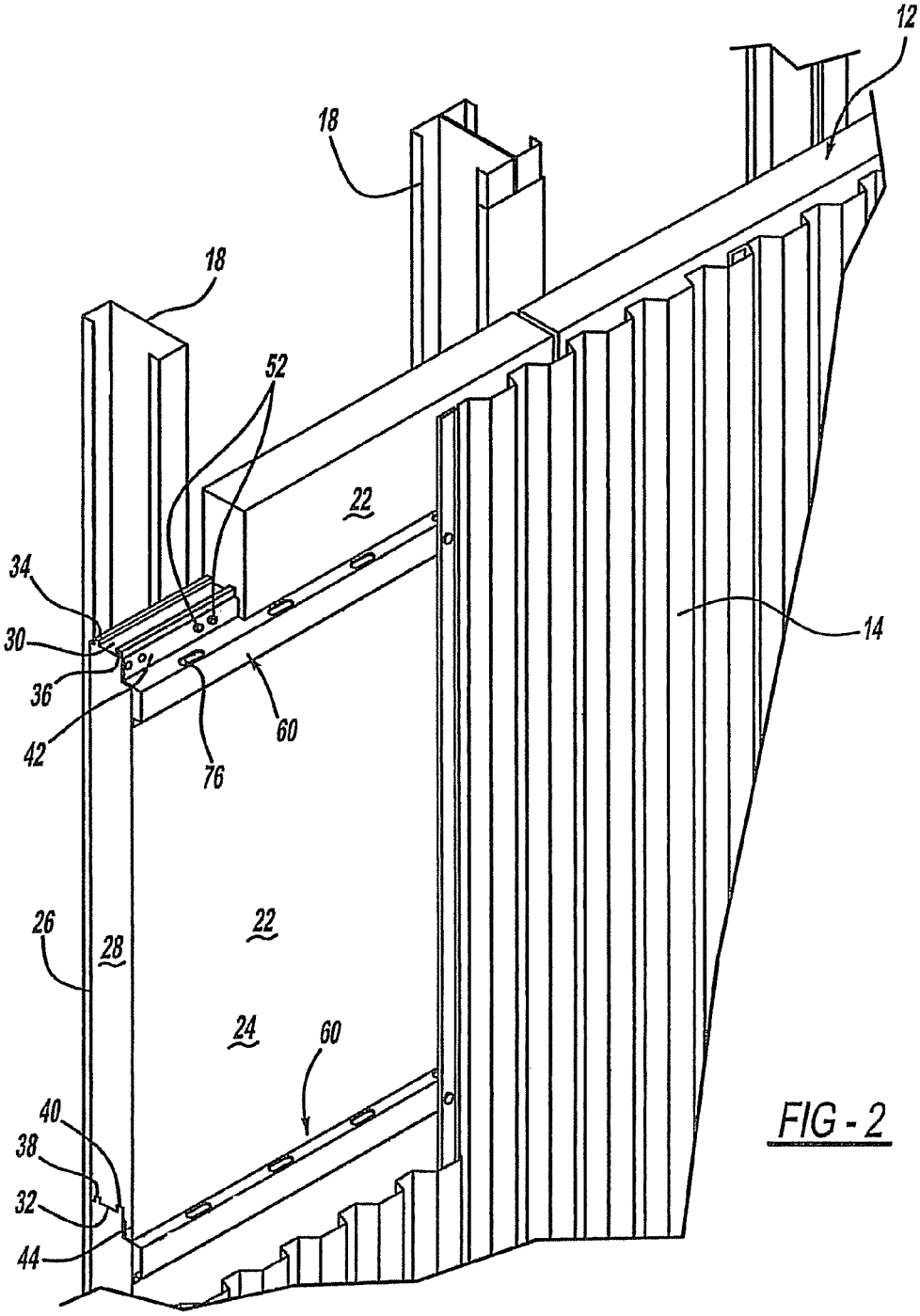
FIG. 2 is a perspective view partially in section of a wall with horizontal panels.
Figure 4:
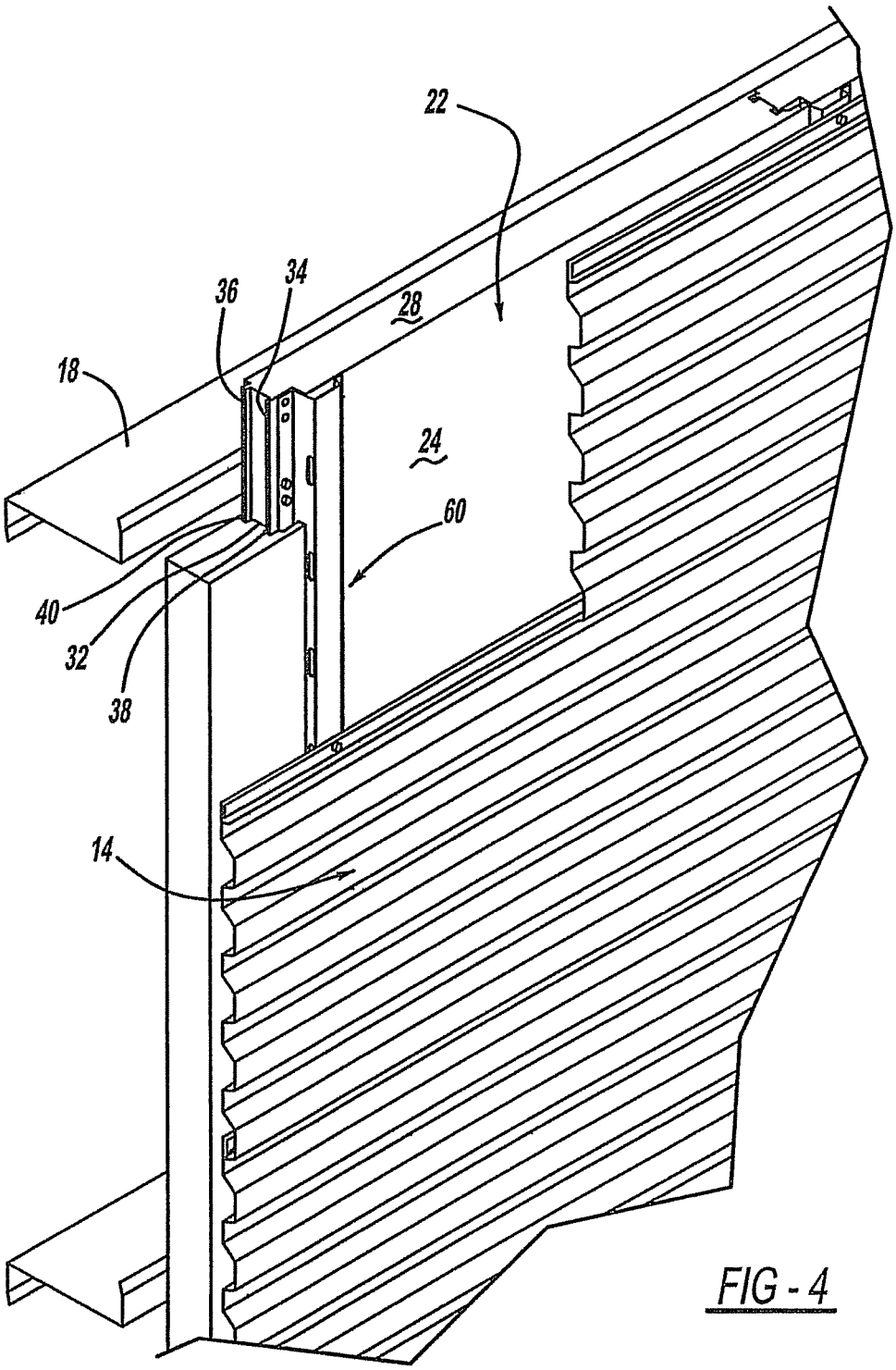

FIG. 4 is a perspective breakaway view like FIG. 2 with a vertical rail and horizontal single skin.

Figure 5:
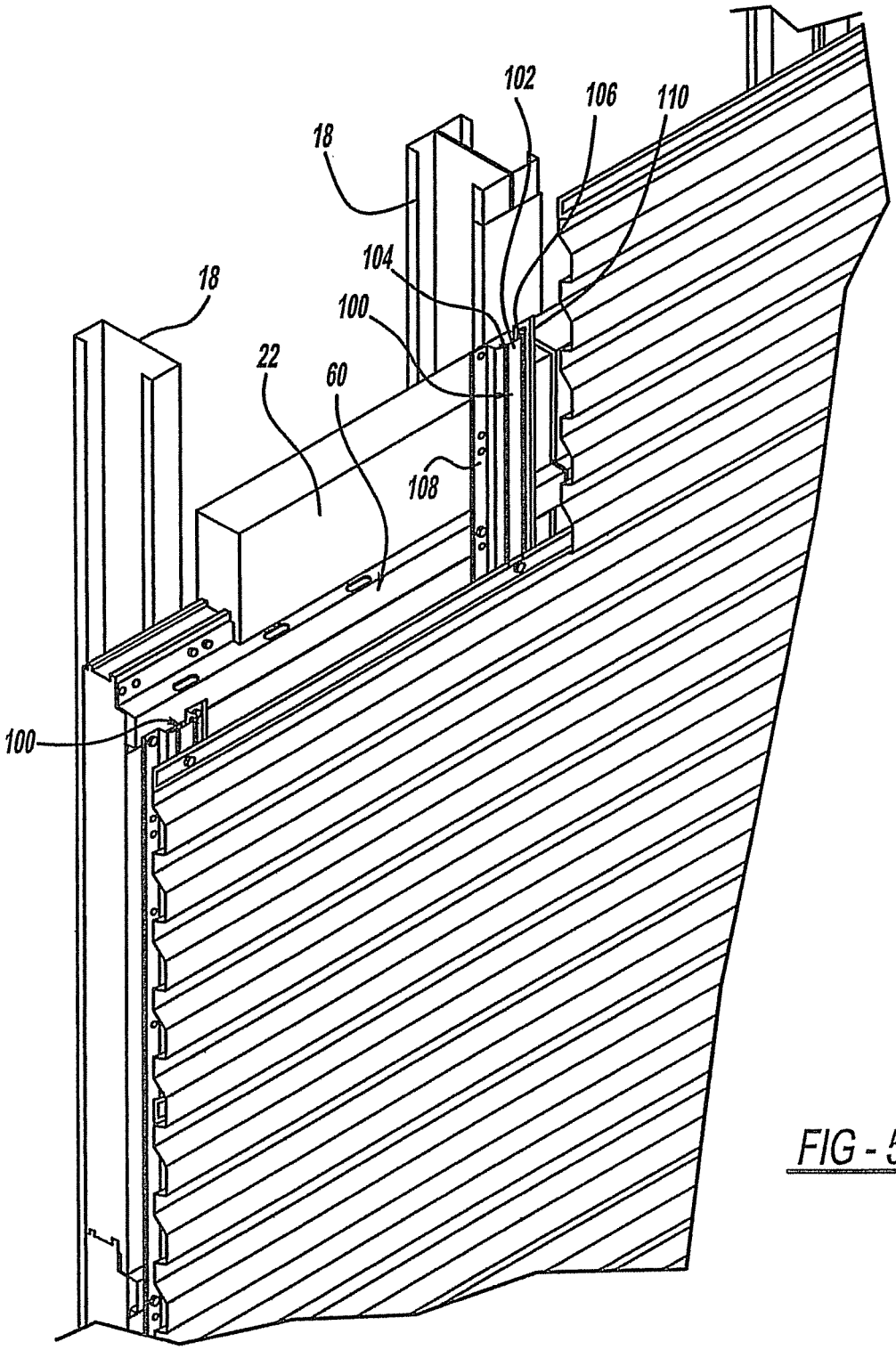

FIG. 5 is a perspective breakaway view of a second embodiment with the panels in a horizontal position.

Figure 6:
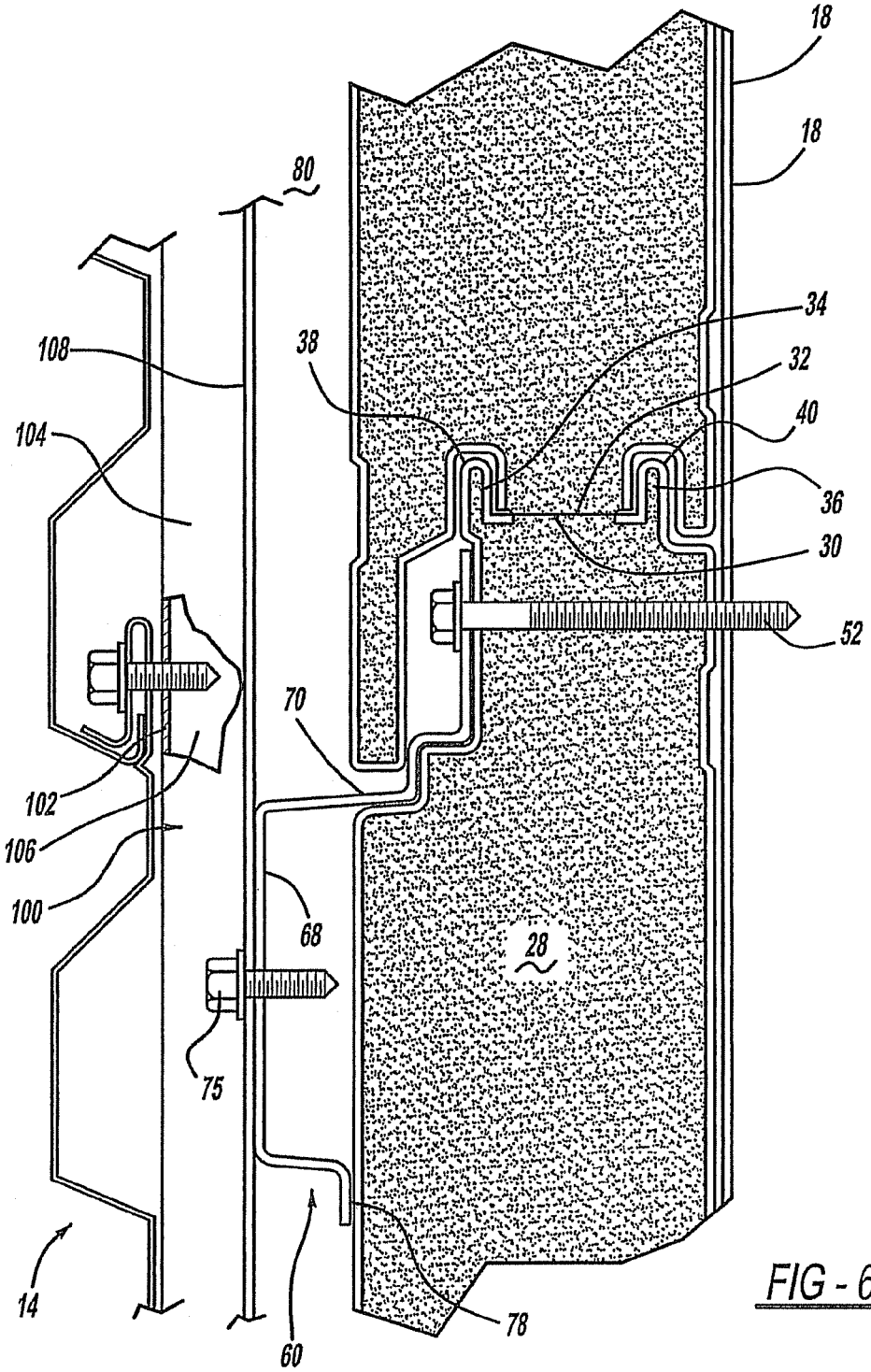

FIG. 6 is a cross-section view of FIG. 5 along lines 6-6 thereof.

Figure 7:
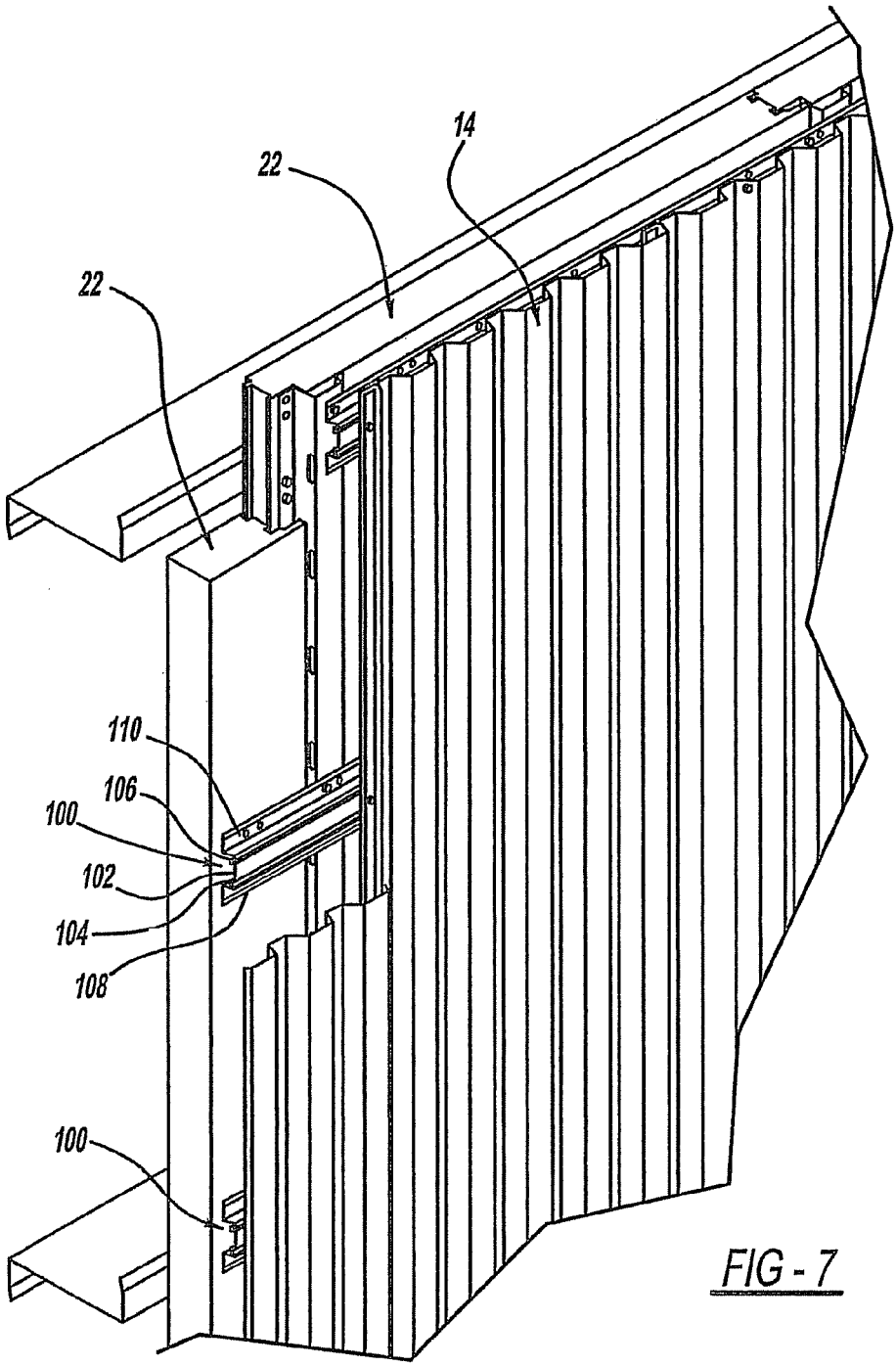

FIG. 7 is a view like FIG. 5 with the panels in a vertical position.

Figure 8:
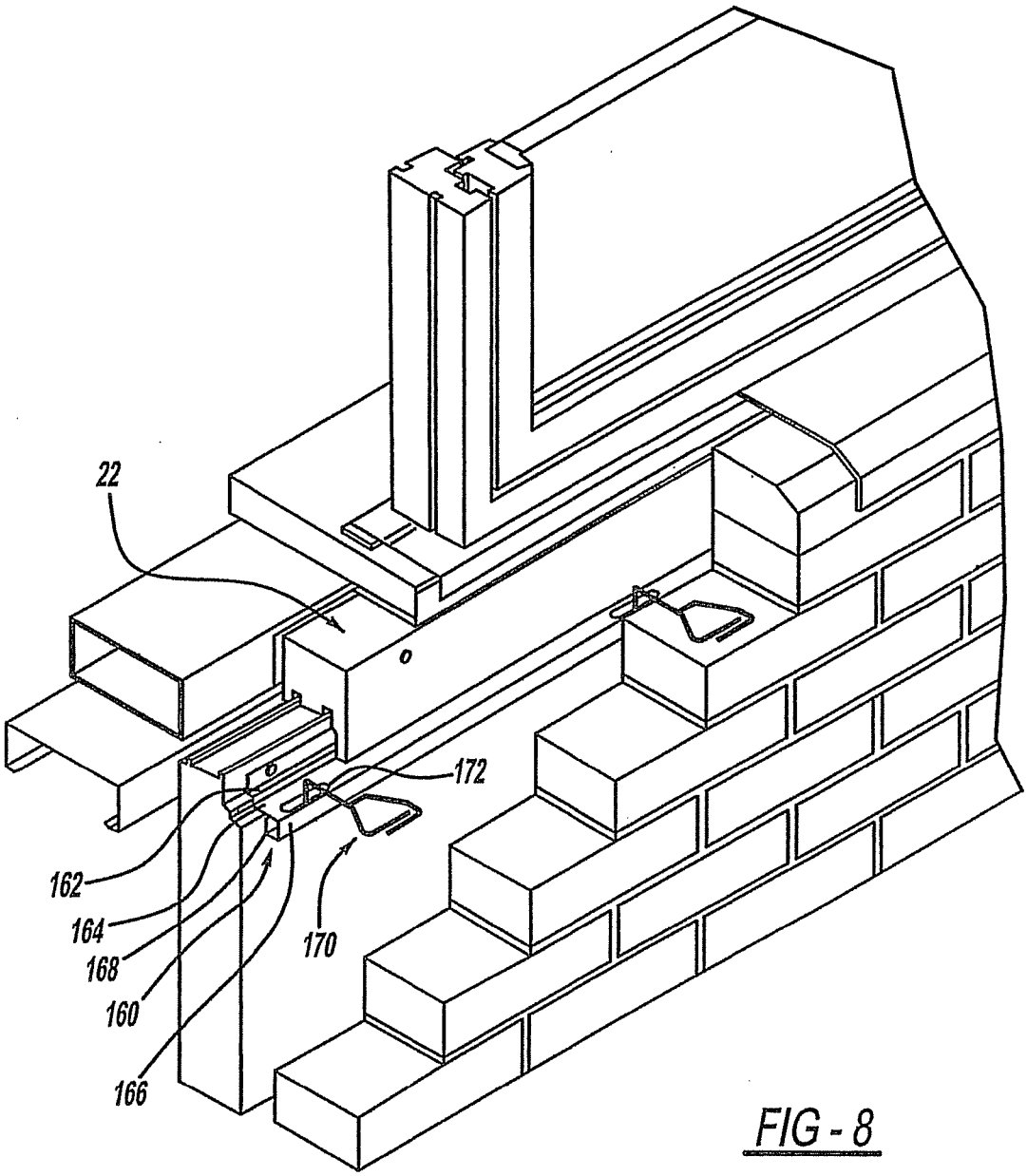

FIG. 8 is a perspective breakaway view of another embodiment with the panels in a horizontal position.

DETAILED DESCRIPTION

Figure 1:
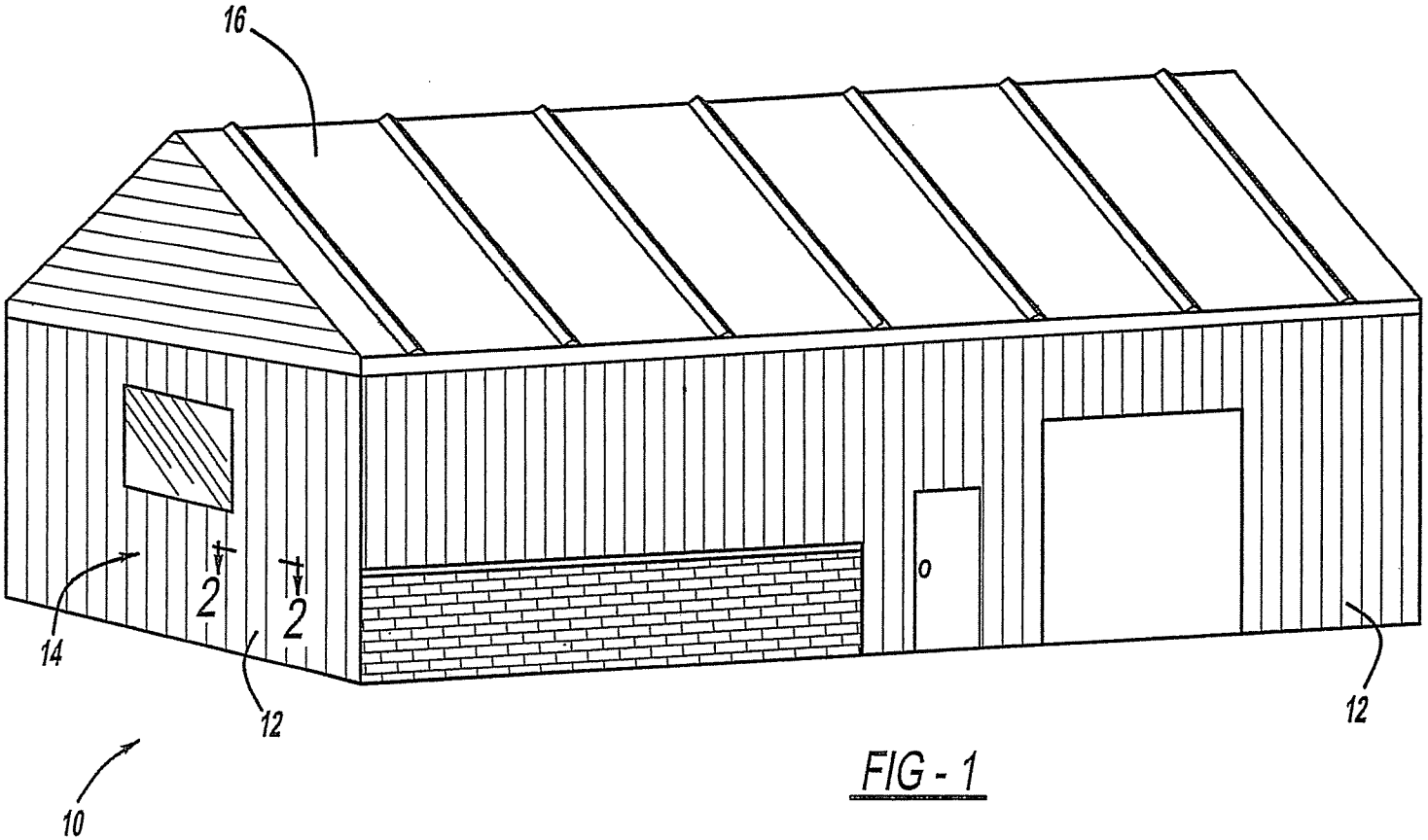
FIG. 1 is a perspective view of a building.

Turning to the figures, FIG. 1 shows a perspective view of a building. The building 10 includes walls 12 that include an outer façade 14. The building generally has a roof 16 and a framing structure 18 on which the walls 12 are secured.

Turning to FIG. 2, a breakaway of the wall 12 is illustrated. The wall 12 includes the façade 14 as well as a plurality of insulated panels 22. The panels 22 generally include an outer skin 24, an inner skin 26 and foam insulating material 28 positioned between the two. The panels 22 are manufactured such that the outer and inner skins 24, 26 are secured with the foam insulation 28. Also, the panels 22 include edges 30, 32. The edges 30, 32 mate with other panels having an opposite edge as illustrated in FIG. 2. In FIG. 2, the edge 30 has a pair of projections 34, 36 extending from the edge 30. The edge 32 includes a pair of recesses 38, 40 to receive the projections 34, 36. Also, the edge 30 includes a cut-out 42 while the edge 32 includes a flange 44 that fits into the cutout 42 as best illustrated in FIG. 3. As can be seen in FIG. 2, the panels are stacked one on top of the other in a horizontal arrangement or configuration. FIG. 4 is a view like FIG. 2 with the panels 22 in a vertical arrangement. The panels are the same; just the orientation has been changed. The panels 22 are secured to the framing structure 18 via fasteners 52. The fasteners 52 secure to the framing structure 18 along the length of the building.

Rails 60 are positioned on the panels 22 and secured to the framing structure 18 by the fasteners 52. The rails 60 are positioned on each panel 22 to enable securement of the façade 14 onto the panels 22. Each bracket or mounting rail 60 is an elongated stamped member having a desired length corresponding to the length of the building. Each rail 60 includes a first portion 62, a second portion 64, and a third portion 66. The first, second and third portions 62, 64, and 66 are continuous with one another and form a one piece bracket or mounting rail 60. The rail 60, in cross-section, has an overall U-shape with one leg 70 longer than the other leg 72 with both legs including a flange 74, 78. The longer leg 70 includes a longer flange 74. The first portion 62 includes the longer flange 74 and includes a plurality of apertures 73 to receive the fasteners 52. The first portion 62 secures the rail 60 with the framing structure 18 via the fasteners 52. The second portion 64 has a U-shape that defines the web 68 and legs 70, 72. The web 68 provides an attachment surface for the façade 14. The web 68 is positioned away from the outer skin 24 such that fasteners 75 securing the façade 14 with the rails 60 do not enter into the panels 22. Additionally, the leg 70 may include apertures 76 that receive members to enhance the attachment of the façade 14 as will be described later. The leg 72 and flange 78 provide rigidity for the web 68. The flange 78 nests on the outer skin 24 to provide rigidity to the web 68. The second and third portions form a top hat design when viewed in cross-section sitting on top of the outer skin of the panels 22 as illustrated in FIG. 3. The one piece rail 60 is shown only attached to the framing structure 18 via the fasteners 52 that pass through the rail apertures 73 as well as through the panels 22.

A fastener for securing the flange 78 with the outer skin of the panel 22 is illustrated in FIG. 3*a*. Here, the fastener 81 includes an internal clamping sleeve 83 and bolt 85. One such fastening system is that referred to as Fablock™. A hole is drilled through the skin and the sleeve 83 is inserted as illustrated in FIG. 3*a*. On tightening of the bolt 85, the sleeve 83 splays and is clamped against the inside surface of the external skin 24. Additionally, as well as being fastened, an additional adhesive could be applied between the flange and the outer skin to enhance the securement. Additionally, the fastener 52 that secures the panels 22 in place likewise provides securement for the bracket or mounting rail 60.

A gap 80 is formed between the façade 14 and the panels 22. The gap 80, which may vary in size, provides a moisture, air and thermal barrier between the façade 14 and the panels 22.

FIG. 4 illustrates the rail 60 positioned vertically along the panels 22. Thus, the same structure can be used on horizontal panels (FIG. 2) or vertical panels depending upon the building construction and framing structure layout.

Turning to FIGS. 5-7, a second embodiment is illustrated. In this embodiment, those elements that are the same as previously described are designated with the same reference numerals. The difference between the first embodiment and the second embodiment lies in the fact that an additional frame member is secured with the rails 60 to enhance securement of the façade 14 to the wall panels 22.

Here, a frame member 100 is secured with the web 68 of the second portion 64 of the rails 60 when the rails are in a horizontal or vertical position as illustrated in FIGS. 5 and 6. The frame member 100 is an elongated member stamped to have a desired shape when viewed in cross-section. The frame member 100 includes a web 102, legs 104, 106 and flanges 108, 110. The flanges 108, 110 receive fasteners 112 to secure the framing member 100 onto the web 68 of the second portion 64 of the rails 60. Thus, as illustrated in FIG. 7, an additional or larger gap is formed between the façade 14 and the panels 22. Here, the façade 14 is secured to the frame members 100.

Turning to FIG. 8, an additional embodiment of the rail 160 is illustrated. Here, the building includes a brick façade 14. The rail 160 includes a first securement portion 162, a second portion 164, and a third portion 166. The first portion 162 is like that previously described. The second and third portions, when viewed in cross-section, define a labyrinth or rectangular helix design. The rail third portion 166 is folded on itself such that a surface 168 rests against the outer skin 24. The helix portion provides increased rigidity for the rail 160.

Brick tie fasteners 170 extend from the apertures 172. The apertures 172 receive the brick ties 170 so that the brick ties 170 can provide leveling of the brick façade 14 as illustrated. Thus, the mortar is positioned on the brick ties 170 to provide securement of the façade with the panels 22 and to level the bricks to provide an aesthetic appearance.

The description of the disclosure is merely exemplary in nature and thus, variations that do not depart from the gist of the disclosure are intended to be within the scope of the disclosure. Such variations are not to be regarded as a departure from the spirit and scope of the disclosure.

What is claimed is:

1. A building wall system comprising:

a plurality of insulated panels, the plurality of insulated panels positioned adjacent one another for securement to a frame structure via first fasteners;

a plurality of rails, each rail including a first, second and third portion, the first portion positioned between the adjacent insulated panels and including a mechanism to receive the first fasteners to enable the first fasteners to be received in the frame structure, the first fasteners secure the rail and the panels to the frame structure, the second portion receiving second fasteners to secure a facade with the rail, the second portion is spaced from the panels such that the second fasteners do not enter the panels, the third portion supports the second portion, the third portion rests against the panel and providing rigidity to the second portion; and a façade attached to the surface of the second portion provides an aesthetic appearance.

2. The building wall system of claim 1, further comprising a mechanism coupled with the rail to enhance securement of the façade.

3. The building wall system of claim 1, wherein the third portion includes a free or fixed end.

4. The building wall system of claim 1, wherein the first, second and third portions are continuous with one another.

5. The building wall system of claim 1, wherein the second and third portions have a top hat cross-section configuration.

6. The building wall system of claim 1, wherein the second and third portions have a labyrinth or rectangular helix cross-section.

7. The building wall system of claim 1, wherein the rail includes a plurality of apertures.

8. The building wall system of claim 1, wherein a gap providing a moisture, air and thermal barrier is formed between the panels and the façade.

9. The building wall system of claim 1 wherein a fastener secures the third portion against the panel.

10. A building comprising:

a frame structure, a wall system and a facade, the wall system including a plurality of insulated panels, the plurality of insulated panels positioned adjacent one another for securement to a frame structure via first fasteners;

a plurality of rails, each rail including a first, second and third portion, the first portion positioned between the adjacent insulated panels and including a mechanism to receive the first fasteners to enable the first fasteners to be received in the frame structure, the first fasteners secure the rail and the panels to the frame structure, the second portion receiving second fasteners to secure the facade with the rail, the second portion is spaced from the panels such that the second fasteners do not enter the panels, the third portion supports the second portion, the third portion rests against the panel and provides rigidity to the second portion; and the facade attached to the surface of the second portion and provides an aesthetic appearance.

11. The building of claim 10, further comprising a mechanism coupled with the rail for enhancing securement of the façade.

12. The building of claim 10, wherein the third portion includes a free or fixed end.

13. The building of claim 10, wherein the first, second and third portions are continuous with one another and form a one piece rail.

14. The building of claim 10, wherein the second and third portions have a top hat cross-section configuration.

15. The building of claim 10, wherein the rail includes a plurality of apertures.

16. The building of claim 10, wherein a gap providing a moisture, air and thermal barrier is formed between the frame structure, panels and the façade.

17. The building of claim 10 wherein a fastener secures the third portion against the panel.

18. A method of building a building wall system comprising:

positioning a first panel adjacent a framing structure;

aligning at least one rail on the first panel;

securing the at least one rail and first panel to the framing structure by passing a first fastener through the at least one rail and first panel and securing, via the first fastener passing through, the at least one rail and first panel to the framing structure;

continuing positioning of panels and aligning rails until the building wall system is formed; and attaching a façade to the rail.

19. The method of claim 18, further comprising securing a mechanism with the rail to enhance attaching of the façade.

20. A building wall system comprising:

a plurality of insulated panels, the plurality of insulated panels positioned adjacent one another for securement to a frame structure via first fasteners;

a plurality of brackets, each bracket including a first and second portion and each bracket positioned between the adjacent insulated panels, the first portion including a mechanism to receive the first fasteners to enable the first fasteners to be received in the frame structure, the first fasteners secure the plurality of brackets and the panels to the frame structure, the second portion receiving second fasteners to secure a facade with the plurality of brackets, the second portion is spaced from the panel such that the second fasteners do not enter the panel; and a façade attached to the surface of the second portion provides an aesthetic appearance.

21. The building wall system of claim 20, wherein the plurality of brackets includes a plurality of apertures.

22. A building comprising:

a frame structure, a wall system and a facade, the wall system including a plurality of insulated panels, the plurality of insulated panels positioned adjacent one another for securement to a frame structure via first fasteners;

a plurality of brackets, each bracket including a first and second portion, the first portion positioned between the adjacent insulated panels, the first portion including a mechanism to receive the first fasteners to enable the first fasteners to be received in the frame structure, the first fasteners secure the plurality of brackets and the panels to the frame structure, the second portion receiving second fasteners to secure the facade with the plurality of brackets, the second portion is spaced from the panels such that the second fasteners do not enter the panels; and the facade attached to the surface of the second portion and provides an aesthetic appearance.

23. A method of building a building wall system comprising:

positioning a first panel adjacent a framing structure;

aligning at least one bracket on the first panel;

securing the at least one bracket and first panel to the framing structure by passing a first fastener through the at least one bracket and first panel and securing, via the first fastener passing through, the at least one bracket and first panel to the framing structure;

continuing positioning of panels and aligning brackets until the building wall system is formed; and attaching a facade to the brackets.

* * * * *